United States Patent [19]

McGowan

[11] Patent Number: 4,999,980

[45] Date of Patent: Mar. 19, 1991

[54] STRAP COMPONENT

[75] Inventor: John C. McGowan, Woodborough, United Kingdom

[73] Assignee: Aerborn Equestrian Limited, Nottingham, England

[21] Appl. No.: 456,343

[22] Filed: Dec. 26, 1989

[51] Int. Cl.[5] ..... B68C 1/14

[52] U.S. Cl. ..... 54/23; 24/302; 2/338

[58] Field of Search ..... 119/106, 109; 54/23, 54/34, 36, 46; 2/338; 24/300, 301, 302

[56] References Cited

U.S. PATENT DOCUMENTS

| | | | |
|---|---|---|---|
| 2,102,561 | 12/1937 | Loeber | 2/338 X |
| 2,274,652 | 3/1942 | Bayon | 2/338 X |
| 4,769,875 | 9/1988 | Hartman | 24/300 |

FOREIGN PATENT DOCUMENTS

| | | | |
|---|---|---|---|
| 5948 | 4/1899 | United Kingdom | 54/23 |
| 515868 | 12/1939 | United Kingdom | 54/23 |
| 1502138 | 2/1978 | United Kingdom . | |

*Primary Examiner*—Robert P. Swiatek

*Attorney, Agent, or Firm*—Lorusso & Loud

[57] ABSTRACT

The invention provides a strap component for equipment such as equestrian harness or saddlery equipment. The strap component comprises a plurality of elongate tubular portions each containing an elongate cord. The tubular portions and the elongate cords are woven integrally from continuous filament crimped polyester and crimped polypropylene respectively. A binding piece at each of the strap covers the end and provides attachment for buckles or short straps.

13 Claims, 3 Drawing Sheets

STRAP COMPONENT

Figures 1, 1A, 1B:
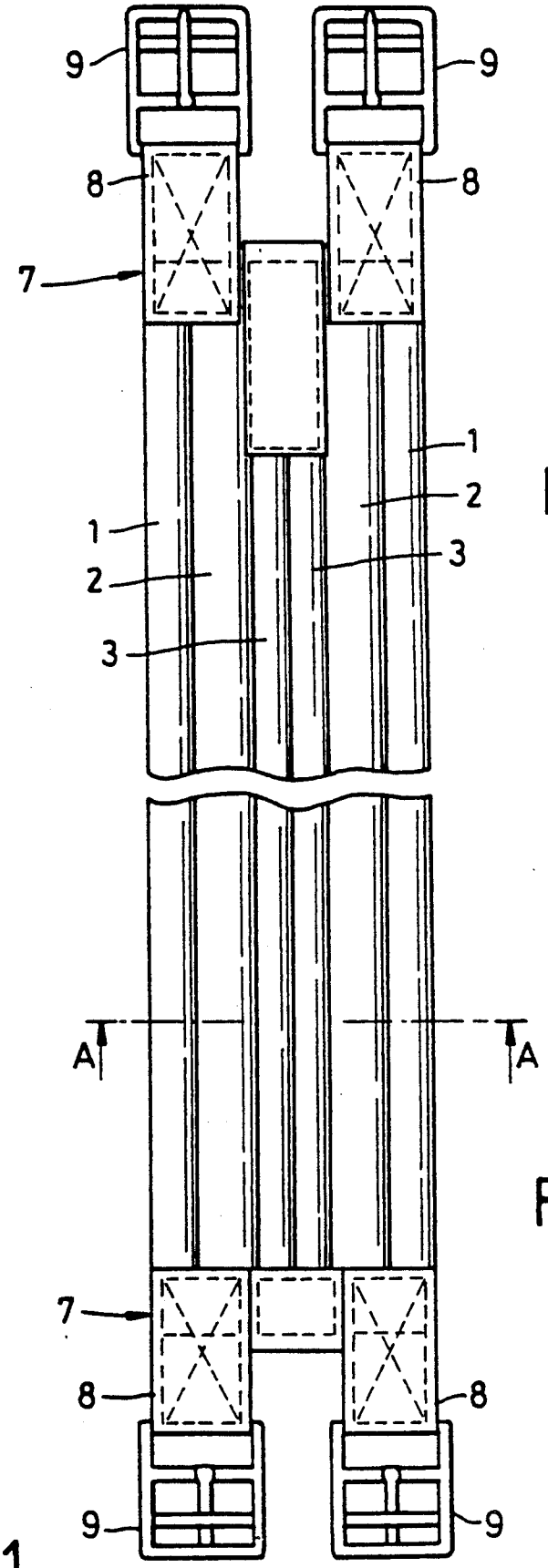

This invention relates to a strap component and more particularly to a strap component of equipment such as equestrian harness or saddlery equipment.

Traditionally, the strap components of equipment such as equestrian harness and saddlery equipment have been made of leather. However, this is expensive as the leather must be carefully selected and prepared and careful maintenance is required. There has therefore been some interest in the use of alternative materials. Such alternatives have been found to encounter problems such as a short lifespan due to rotting and the inability to cope with sweat from the horses, insufficient of excessive elasticity and a tendency to chafe the horse.

GB 1502138 describes a strap for equestrian harness or saddlery equipment which comprises a woven sheath of staple fibres of synthetic polymer material and a filling of foam expanded plastics material which is introduced into the sheath with a removable trough-shaped carrier. However, this strap has also been found to suffer from some of the problems mentioned above. The present invention seeks to provide an improved strap component to reduce the problems previously encountered.

The invention provides a strap component which is integrally woven comprising a plurality of elongate tubular portions, each tubular portion containing an elongate cord. The elongate cord may comprise a plurality of smaller cords.

The elongate tubular portions are woven from man-made continuous filament fibres, preferably continuous filament crimped polyester. Any other suitable material such as cotton staple fibre yarn or man-made staple fibre yarn may also be used.

The elongate cords are woven from crimped filament yarn, preferably crimped polypropylene. Any other suitable material may be used however, such as other generic yarns, and may include rubber or foam.

Desirably, the elongate card substantially fills the elongate tubular portion in which it is contained.

Advantageously, the strap component is resiliently stretchable to a limited extent. By a "limited extent" we mean that when suitable force is applied to the strap component, it will extend in length by between 5% and 10%. This extension is within the elastic limit of the strap component. If extreme force is applied to extend the strap component substantially beyond 10% of its length, the strap component will break.

At least one tubular portion extending along the centre portion of the strap component is woven more tightly than the other tubular portions in order to restrict the stretching of the strap component.

Conveniently, each end of the strap component is bound by a binding piece, which preferably comprises at least one short strap.

The invention also provides a method of making the strap component comprising integrally weaving the elongate tubular portions and the elongate cords and sealing the ends of the tubular portions by heat sealing.

Figure 2:
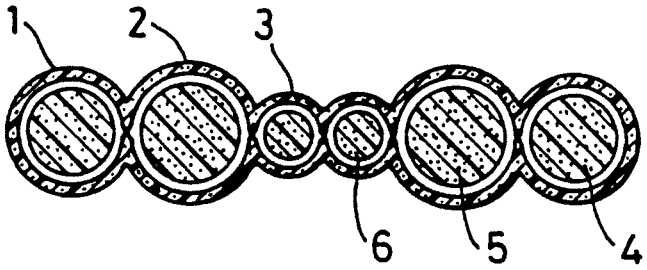
Figure 2A:
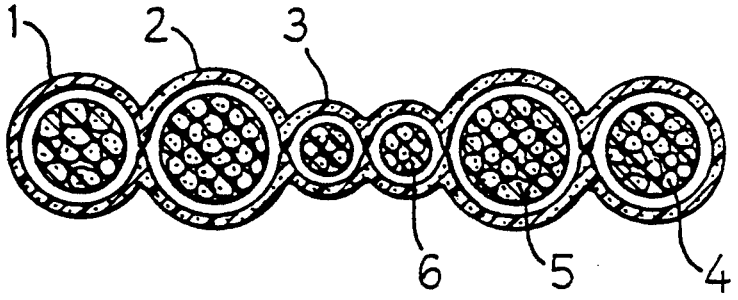

A preferred embodiment of the invention will now be described with reference to the accompanying drawings, in which:

FIG. 1 shows a plan view of the strap component, FIG. 1*a* being a top view and FIG. 1*b* being an underneath view, FIG. 2 shows a transverse section of the strap component along the line A—A of FIG. 1*b*. FIG. 2*a* shows a transverse section of an embodiment of the strap component according to the invention.

The strap component comprises six elongate tubular portions, 1, 2, 3, of continuous filament crimped polyester. Inside each tubular portion 1, 2, 3, is an elongate cord 4, 5, 6 FIG. 2 of crimped polypropylene. Each elongate cord substantially fills its respective tubular portion. As shown in FIG. 2*a*, each elongate cord 4, 5, 6 may comprise a plurality of smaller cords.

Each end of the strap component is covered by a binding piece 7. Each binding piece comprises two short straps 8 (known as billets in the saddlery trade) which carry buckles 9. The binding piece 7 is made from high tenacity polyester, but may be made from any suitable yarn.

The strap component of FIG. 1 is approximately 7.5 cm wide and cut to the required length. The tubular portions 1 are approximately 1.3 cm wide, the tubular portions 2 are approximately 1.5 cm wide and the tubular portions 3 are approximately 0.8 cm wide. The dimensions may be varied according to the desired use of the strap. Other typical widths of the strap component are 2.7 cm and 2.3 cm.

The strap component is made on a narrow fabric weaving loom and is produced by weaving in its entirety, the elongate cords being woven in as the elongate tubular portions 1, 2, 3 are woven around them. The ends of the strap component are then cut with a heated blade, which is the usual method to cut all man-made filament produced straps and cords. The binding piece is sewn over the cut ends of the strap component and provides attachment for the buckles. This has traditionally been done with the "lampwick" girth for a large part of this century. Any suitable fastening means may be used as an alternative to buckles.

The strap component of FIG. 1 is most suitably used as a girth for a horse.

However, the strap component of the present invention may be used for many different parts of equestrian harness and saddlery equipment such as the halter (headcollar) lead rope, bridle and reins and the dimensions of the strap component would be varied accordingly.

The preferred embodiment of the invention has been found to have two main advantages. The crimped yarn of the elongate tubular portions and the elongate cords allow some extension of the length of the strap component extension taking place until the crimp has been taken up. This elasticity allows the strap to move with the horse and reduces the possibility of chafing the horse's body that can occur with a rigid strap. The crimp also provides the strap component with some inherent resilience so that contact with the horses skin is not too harsh. The strap component is also adapted to absorb and evaporate sweat from the horse's body. As sweat is the main cause of severe chafing, this helps reduce the chance of chafe. The material of the elongate cords is hydrophobic so the sweat absorbed is repelled into the material of the elongate tubular portions facing away from the body of the horse. From here, the sweat readily evaporates. The strap is thus able to cope with the sweat absorbed and is not adversely affected.

I claim

1. A strap component which is integrally woven and comprises a plurality of elongate tubular portions woven from man-made continuous filament fibres, each tubular portion containing an elongate cord woven from crimped filament yarn.

2. The strap component according to claim 1 wherein each elongate cord may comprise a plurality of smaller cords.

3. The strap component according to claim 1 wherein the elongate tubular portions are woven from continuous filament crimped polyester.

4. The strap component according to claim 1 wherein the elongate cords are woven from polypropylene.

5. The strap component according to claim 1 wherein the elongate cord substantially fills the elongate tubular portion in which it is contained.

6. The strap component according to claim 1 which is resiliently stretchable to a limited extent.

7. The strap component according to claim 6 wherein at least one tubular portion is woven more tightly than the other tubular portions in order to restrict the stretching of the strap component.

8. The strap component according to claim 1 wherein each end of the strap component is bound by a binding piece.

9. The strap component according to claim 8 wherein the binding piece comprises at least one short strap.

10. The strap component according to claim 1 characterised in that the material of the elongate cords is hydrophobic.

11. The strap component according to claim 1 characterised in that it is adapted to absorb and evaporate sweat from an animal's body.

12. The strap component according to claim 1 for use in equestrian harness or saddlery equipment.

13. A method of making a strap component according to claim 1 comprising integrally weaving the elongate tubular portions and the elongate cords and sealing the ends of the tubular portions by heat sealing.

* * * * *

UNITED STATES PATENT AND TRADEMARK OFFICE

CERTIFICATE OF CORRECTION

PATENT NO. : 4,999,980
DATED : March 19, 1991
INVENTOR(S) : John C. McGowan

It is certified that error appears in the above-indentified patent and that said Letters Patent is hereby corrected as shown below:

Column 4, Claim 10, line 9, insert after "elongate" --tubular portions is hydrophilic and the material of the elongate--.

Signed and Sealed this

Seventh Day of September, 1993

Bruce Lehman

*Attest:*

BRUCE LEHMAN

*Attesting Officer*

*Commissioner of Patents and Trademarks*